United States Patent [19]

Scott

[11] Patent Number: 4,474,089

[45] Date of Patent: Oct. 2, 1984

[54] SCREW HANDLE RATCHET

[76] Inventor: Stephen S. Scott, P.O. Box 1000, Laurie, Mo. 65038

[21] Appl. No.: 412,569

[22] Filed: Aug. 30, 1982

[51] Int. Cl.[3] ..... B25B 17/00

[52] U.S. Cl. ..... 81/57.29; 81/58.1

[58] Field of Search ..... 81/57.29, 58.1; 145/75, 145/76

[56] References Cited

U.S. PATENT DOCUMENTS

| | | | |
|---|---|---|---|
| 1,415,731 | 5/1922 | Terry | 81/57.29 |
| 2,206,802 | 7/1940 | Brenning | 81/57.29 |
| 3,080,900 | 3/1963 | Rosenberg | 145/75 |
| 4,318,314 | 3/1982 | Furedi et al. | 81/57.29 |
| 4,406,184 | 9/1983 | Cockman | 81/57.29 |

*Primary Examiner*—James L. Jones, Jr.

*Attorney, Agent, or Firm*—Kokjer, Kircher, and Brodley

[57] ABSTRACT

A driver for socket wrenches or similar tools constructed to effect rotation of the wrench by rotary wrist action. Manual rotation of a grip is transmitted through shafts and gears to the tool lug and a ratchet mechanism is provided to permit the selective transmission of torque to the tool in either direction of grip rotation. The mechanism is lockable to override the lost motion ratcheting action when desired. A tool receiving recess in the grip permits the application of increased torque when required to rotate the tool lug.

2 Claims, 3 Drawing Figures

SCREW HANDLE RATCHET

This invention relates to hand tools, and more particularly to a handle for driving socket tools such as wrenches, screwdrivers and the like.

Conventional socket wrench handles are constructed to provide leverage for turning the socket to which the handle is attached. The handle extends radially from the axis of socket rotation and the manual swinging of the handle about this axis turns the socket. Frequently a ratchet mechanism is employed to permit such swinging through a limited arc to effect rotation of the socket. This greatly enhances the versatility of the tool by permitting its use in relatively close quarters where there is insufficient room for swinging the handle through entire revolutions. Some such handles are jointed to permit limited articulation at an angle to the axis of rotation so that the tool can be used in locations where obstructions would otherwise limit the space through which the handle must swing.

Handles of the type described are highly beneficial and are in widespread use. However, there are some applications and some procedures during the normal use of a tool of this type where it is desirable to effect turning of the socket without the necessity for any swinging of the handle at all. For example, if the available space is too limited to permit effective swinging of the handle, such conventional handles cannot be used. Further, except for the initial torque required for tightening or loosening of a nut, the rotation of the nut on the threads of a bolt is often accomplished quite easily and does not require the increased leverage afforded by the handle swing. The swing represents a certain amount of wasted motion during such operations and is inconvenient where space is limited.

Accordingly, it is a primary object of this invention to provide a handle for socket wrenches or similar tools wherein the socket projection or lug may be rotated by a simple turning motion axially of the handle without the necessity for swinging the handle itself.

It is another important object of the invention to provide such a handle wherein the socket lug may be driven in either direction depending on the direction the handle is turned by the operator.

Another object of the present invention is to provide a handle as aforesaid having a ratchet mechanism wherein the socket lug may be selectively turned in a single direction responsive to back and forth twisting movement of the handle by the operator, thus permitting the operator to use the tool without having to remove his hand therefrom during its operation.

Another object of the present invention is to provide a tool of this type which is capable of being operated in a conventional manner when the particular torque requirements make such operation desirable.

Still a further object of the present invention is to provide a tool handle which incorporates attaching structure to permit the use of an auxilliary drive to rotate the handle and operate the socket lug when additional torque is required.

These and other aims and objectives of the present invention will be further explained or will become apparent from the following description and explanation of the drawing wherein.

Figure 1:
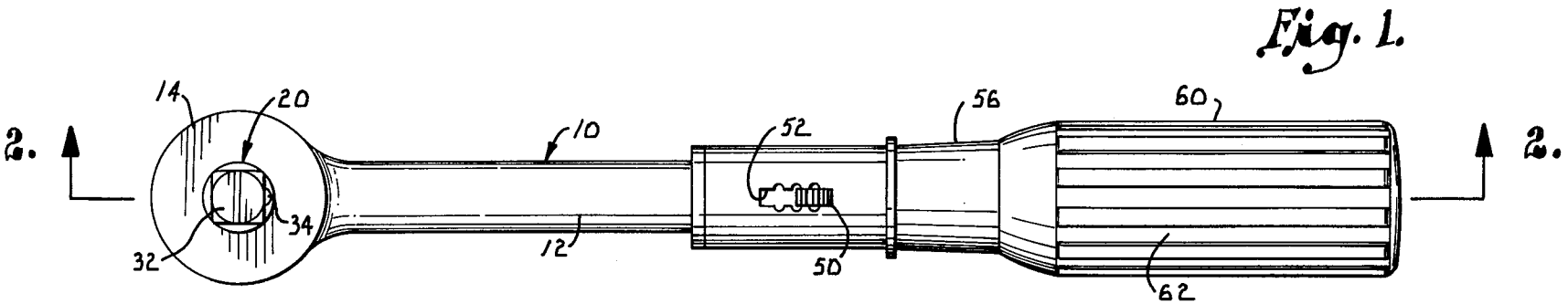
FIG. 1 is a top plan view of a handle embodying the principles of this invention.
Figure 2:
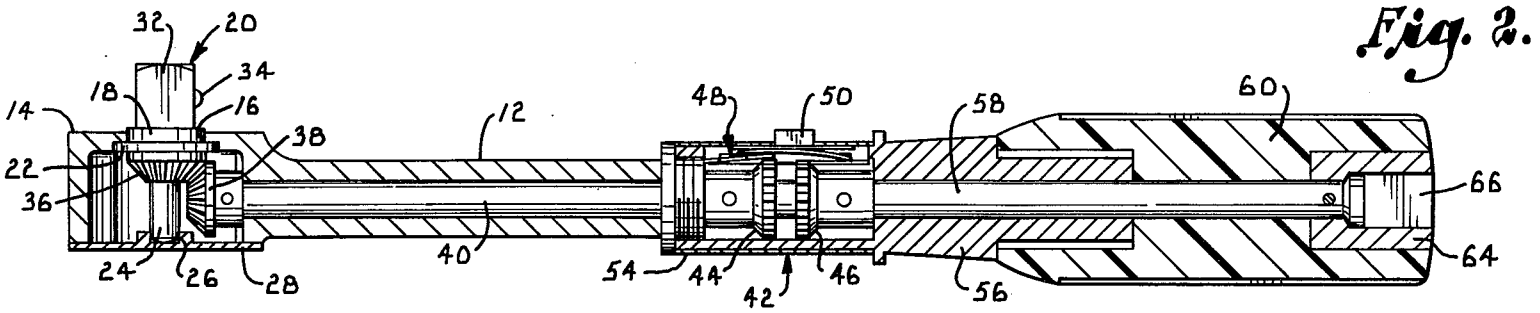
FIG. 2 is a detailed cross-sectional view taken along line 2—2 of FIG. 1, certain parts being shown in elevation for clarity.
Figure 3:
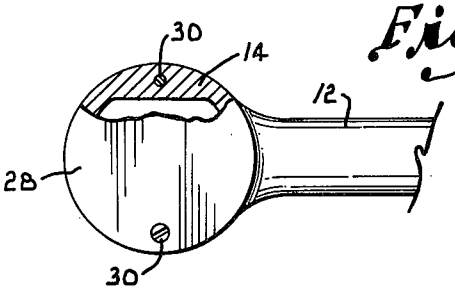
FIG. 3 is a fragmentary, bottom plan view thereof, parts being broken away to reveal details of construction.

A tool handle embodying the invention is broadly designated by the reference numeral 10 and comprises a tubular housing 12 having an integral, generally circular, hollow enlargement 14 at the end of the housing. One side of enlargement 14 is open and the other side has a bore 16 extending therethrough. A transversely circular bearing surface 18 of a connector member broadly designated by the reference numeral 20 is complementally received in bore 16 for rotation about the longitudinal axis of member 20. A circular flange 22 integral with surface 18 is of a greater diameter than the latter and serves to retain member 20 in proper position in housing enlargement 14 as shown in FIG. 2 of the drawing. Member 20 includes an integral shaft 24 extending axially of the member and having its projecting end received in a bearing 26 forming an integral part of a cover plate 28. The latter is removably secured in covering relationship over the normally open side of housing enlargement 14 by means of screws 40. A projection 32 in the form of a transversely polygonal lug is integral with member 20 and extends through bore 16 outwardly from the surface of enlargement 14. Projection 32 is of conventional construction and is adapted to releasable receive thereon a socket wrench, socket screwdriver or similar tool. A spring biased ball or detent 34 engages the wrench or screwdriver in conventional fashion to enhance frictional contact and prevent inadvertent disengagement of the tool.

A bevel gear 36 is mounted on member 20 in axial concentricity with shaft 24 and immediately below flange 22 as illustrated in FIG. 2 of the drawing. Gear 36 may be either integrally constructed as a part of member 20 or, in the alternative, can be rigidly secured to shaft 24 for rotation with the latter and with projection 32. A second gear 38 in the interior of housing enlargement 14 is meshed with gear 36 and is, in turn, keyed to an elongated shaft 40 which is rotatably received in tubular housing 12. The end of shaft 40 opposite gear 38 is, in turn, keyed to a selective rotary motion device in the nature of a ratchet 42. Ratchet 42 is of conventional construction as will be readily understood by those skilled in the art and forms no part of the present invention per se. Accordingly, ratchet 42 need not be described in detail other than to point out that it comprises a pair of toothed wheels 44 and 46, each wheel having teeth slanted in a direction opposite from the slant of the teeth of the other wheel so that driving rotary motion can be imparted in one direction while lost rotary motion is available in the opposite direction depending upon the position of a pawl mechanism 48, relative to the respective ratchet wheels 44 and 46. This relationship of pawl mechanism 48 is manually controlled by a slide 50 which projects outwardly through a slot 52 in a tubular ratchet cover 54. One available position of pawl mechanism 48 interlocks the ratchet wheels 44 and 46 for rotation of the wheels together in either direction.

A tubular spindle 56 is mounted in longitudinal extension of housing 12 on the side of ratchet 42 opposite shaft 40. Spindle 56 rotatably receives an elongated shaft 58 having one end thereof secured to ratchet 42 and the other end rigidly secured to a generally transversely circular grip 60 so that rotation of the latter rotates shaft 58 to turn ratchet 42. Grip 60 may be provided with circumferentially spaced elongated grooves 62 to enhance the hand hold which an operator may make on the grip for rotating the latter as will be hereinafter explained. The end of shaft 58 remote from ratchet 42 is keyed to a connector 64 having a transversely polygonal recess 66 extending therein and communicating with the outermost projecting end of grip 60 as shown clearly in FIG. 2 of the drawing. Connector 64 may be constructed of relatively strong material such as steel or the like and is intended as an adjunct to permit the insertion of a tool such as a ratchet driver (not shown) for imparting substantial rotational torque to shaft 58 as will be hereinafter described. Recess 66 could be fashioned from the material of grip 60 without necessity for a separate connector if grip 60 is formed from material having sufficient strength such as steel. Connector 64 is preferably formed of steel and the remainder of the grip may then be of a suitable high strength plastic.

In operation the tool such as a socket wrench is installed over projection 32 in conventional fashion. Ratchet slide 50 may be initially moved to the position causing pawl mechanism 48 to interlock wheels 44 and 46. With the ratchet locked in this manner, the tool handle can be swung in conventional fashion to impart torque to a nut to, for example, loosen the latter. Once the nut has been loosened, slide 50 can be moved to a position where axial rotation of grip 60 by the operator transmits rotational torque through shaft 58, ratchet 42, shaft 40 and gear 38 to cause corresponding rotation of gear 36 and connector member 20. Such rotation can be utilized to unscrew the nut from a bolt without the necessity for any further swinging of the handle around the axis of member 20. It will be readily recognized by those skilled in the art that, for certain applications particularly where space is limited, slide 50 might initially be placed in a position to transmit torque in one direction upon rotation of grip 60 and to provide lost motion upon rotation of grip 60 in the opposite direction. Thus, the operator could by simple back and forth rotation to grip 60, cause projection 32 to turn to remove a nut or perform a similar function without any necessity for swinging movement about the axis of member 20 at all. In such case, if the torque required to start the unthreading of the nut on the screw were sufficiently great as to be difficult to be overcome by manual rotation of grip 60, the operator could insert another tool into recess 64 at the end of the grip and rotate projection 32 by turning the grip on its longitudinal axis in this manner.

It is thus apparent that driver 10 is an extremely versatile adjunct for socket wrenchs, screwdrivers and other tools in that the tool may be rotated manually by the operator simply by wrist action. Such rotation can be effected in extremely close quarters where the conventional swinging movement of heretofore available tools for this purpose is virtually or entirely impossible. The ratchet mechanism interposed between the grip and socket projection permits driving torque to be imparted in either direction of the operator's wrist movement as selected by the operator through manipulation of the ratchet slide. The tool can be used in this manner for removing or installing fasteners such as nuts or the like and is quickly and conveniently operable to effect the necessary drive in either direction.

I claim:

1. A socket wrench driver comprising:

an elongate handle having an enlarged head on one end;

a hand grip mounted on said handle for rotation about the axis of the handle on the end thereof opposite said one end;

a first shaft received in said handle for axial rotation, said first shaft being connected with said hand grip for rotation therewith;

a second shaft received in said handle for axial rotation, said second shaft being substantially coaxial with said first shaft and having one end located in said enlarged head;

a ratchet mechanism in said handle at a location between said first and second shafts intermediate the length of the handle, said ratchet mechanism having a first condition wherein rotation of said first shaft in one rotative direction effects rotation of said second shaft in said one rotative direction but rotation of said first shaft in the opposite rotative direction does not rotate said second shaft and a second condition wherein rotation of said first shaft in said opposite rotative direction effects rotation of said second shaft in said opposite rotative direction but rotation of said first shaft in said one rotative direction does not rotate said second shaft, said ratchet mechanism having a third condition wherein said shafts are coupled together for rotation in unison in both rotative directions;

a connector mounted on said enlarged head for rotation about an axis perpendicular to and intersecting with the axes of said shafts, said connector being adapted to receive a tool element for rotation of the tool element in response to rotation of the connector;

a bevel gear set in said enlarged head connecting said one end of the second shaft with said connector to effect rotation of said connector in opposite directions in response to rotative of said second shaft in opposite directions; and a three position adjustment element for said ratchet mechanism for effecting the first, second and third conditions thereof, said adjustment element being located adjacent said ratchet mechanism on the exterior of said handle intermediate the length thereof, whereby said connector can be turned in opposite directions by rotating said hand grip in opposite directions with said ratchet mechanism in the first and second conditions thereof and said connector can also be turned in opposite directions by swinging the handle in opposite directions about the axis of said connector with said ratchet mechanism in the third condition thereof.

2. The invention of claim 1, including a cavity in said hand grip extending into an end portion thereof and an insert secured in said cavity, said insert being constructed of a material different from said grip and presenting a polygonal recess therein for receiving a tool to facilitate rotation of the hand grip by the tool.

* * * * *